US005349895A

United States Patent [19]

DiCarlo

[11] Patent Number: 5,349,895

[45] Date of Patent: Sep. 27, 1994

[54] AIR MOTOR CONTROL

[75] Inventor: Leonard J. DiCarlo, St. Louis, Mo.

[73] Assignee: McNeil (Ohio) Corporation, St. Paul, Minn.

[21] Appl. No.: 980,552

[22] Filed: Nov. 23, 1992

[51] Int. Cl.[5] ..... F01B 25/06

[52] U.S. Cl. ..... 91/221; 60/379

[58] Field of Search ..... 91/219, 221, 435; 60/379

[56] References Cited

U.S. PATENT DOCUMENTS

| | | | |
|---|---|---|---|
| 956,287 | 4/1910 | Champ . | |
| 967,963 | 8/1910 | Onsrud . | |
| 977,486 | 12/1910 | Thompson . | |
| 1,957,490 | 5/1934 | Davis | 137/153 |
| 1,958,503 | 5/1934 | Wintzer | 230/5 |
| 2,023,771 | 12/1935 | Ringius | 103/37 |
| 2,201,248 | 5/1940 | Stone | 91/219 |
| 2,224,463 | 12/1940 | Wineman | 91/221 |
| 2,765,804 | 10/1956 | Dinkelkamp | 137/95 |
| 2,898,005 | 8/1959 | Rotter | 222/135 |
| 3,816,025 | 6/1974 | O'Neil | 417/9 |
| 4,181,066 | 1/1980 | Kitchen et al. | 91/306 |
| 4,333,827 | 6/1982 | Cummins, II | 210/100 |
| 4,462,759 | 7/1984 | McGeehee | 417/46 |
| 4,846,045 | 7/1989 | Grach et al. | 91/306 |
| 4,889,472 | 12/1989 | Decker et al. | 417/46 |

*Primary Examiner*—Edward K. Look
*Assistant Examiner*—F. Daniel Lopez
*Attorney, Agent, or Firm*—Senniger, Powers, Leavitt & Roedel

[57] ABSTRACT

An improved runaway control for an air motor operable on increase in speed of the air motor above a speed limit stop the motor. The control includes a pressure-responsive device having an air chamber for air under pressure. Further provided is a movable member which moves away from a first position in response to increase in air pressure in the chamber above a predetermined limit to a second position, and movable back to the first position on reduction of pressure in the chamber below the limit. The movable member, when in its first position, enables the operation of the air motor, and when in its second position, cuts off the operation of the motor. An air pump is interconnected with the air motor for operation simultaneously with the motor for delivering air under pressure at a rate related to the speed of the motor to the chamber. On increase in speed of the motor above the speed limit, the pump delivers air under pressure at an increased rate to the chamber over and above the capability of a bleed to bleed off the increase, and on ensuing increase in air pressure in the chamber above the limit, the movable member moves to its the second position to cut off the motor.

11 Claims, 6 Drawing Sheets

AIR MOTOR CONTROL

BRIEF SUMMARY OF THE INVENTION

This invention relates to air motor controls, and more particularly to a runaway control for an air motor responsive to increase in speed of the motor above a predetermined speed on reduction of load on the motor.

The runaway control of this invention has been developed particularly for controlling an air motor of the expansible chamber type comprising a cylinder and a piston reciprocable in the cylinder driving a pump for pumping materials such as sealants, where a problem of pump runaway is at times encountered, due for example to breakage of a discharge line or exhaustion of the supply of the material being pumped. On such discharge line breakage, for example, the load on the motor is reduced, and the motor speeds up and drives the pump at very high speeds, which can damage the pump and cause expensive and time-consuming clean-up of spills of the material. While external or stand-alone governors may be provided for cutting off the air motor under these circumstances, these systems cannot be calibrated so that they activate to cut off the air motor at predetermined speeds; and they are also very sensitive since they sense pressure drops in passaging located in the air motor.

Among the several objects of this invention may be noted the provision of a runaway control or governor for the air motor for stopping the motor if it should start to run away on accouter of pump discharge line breakage, exhaustion of material being pumped, or other problem which might lead to runaway; the provision of such a control in which the length of time for cutting off the air motor is dependent upon the operating speed of the air motor above a predetermined speed limit; and the provision of such a control which is efficient and durable in use and cost-efficient to construct.

Generally, this invention involves an improved runaway control for an air motor of the expansible chamber type comprising an air cylinder, a piston reciprocable therein, and valve means shiftable alternately to effect supply of air to and venting of air from opposite sides of the piston to reciprocate the piston. The control is operable on increase in speed of the air motor above a speed limit to stop the motor. It comprises pressure-responsive means comprising means defining an air chamber for air under pressure and means movable away from a first position in response to increase in air pressure in the chamber above a predetermined limit to a second position, and movable back to the first position on reduction of pressure in the chamber below the limit. The movable means, when in its first position, enables the operation of the air motor, and when in its second position, cuts off the operation of the motor. The pressure-responsive means has a bleed for bleeding off pressure from the chamber at a controlled rate. An air pump is controlled by the air motor. The pump is interconnected with the motor for operation simultaneously with the motor for delivering air under pressure at a rate related to the speed of the motor and having an outlet in communication with the chamber for the delivery of the air under pressure to the chamber. The pressure in the chamber is controlled by the rate of delivery of air under pressure to the chamber and the bleed of air from the chamber. On increase in speed of the motor above the speed limit, the pump, operating at increased speed, delivers air under pressure at an increased rate to the chamber over and above the capability of the bleed to bleed off the increase, and on ensuing increase in air pressure in the chamber above the limit, the movable member moves to its second position to cut off the motor.

Other objects and features will be in part apparent and in part pointed out hereinafter.

BRIEF DESCRIPTION OF THE DRAWINGS

Corresponding parts are designated by corresponding reference numerals in the several views of the drawings.

DETAILED DESCRIPTION OF THE PREFERRED EMBODIMENT

Figure 1:
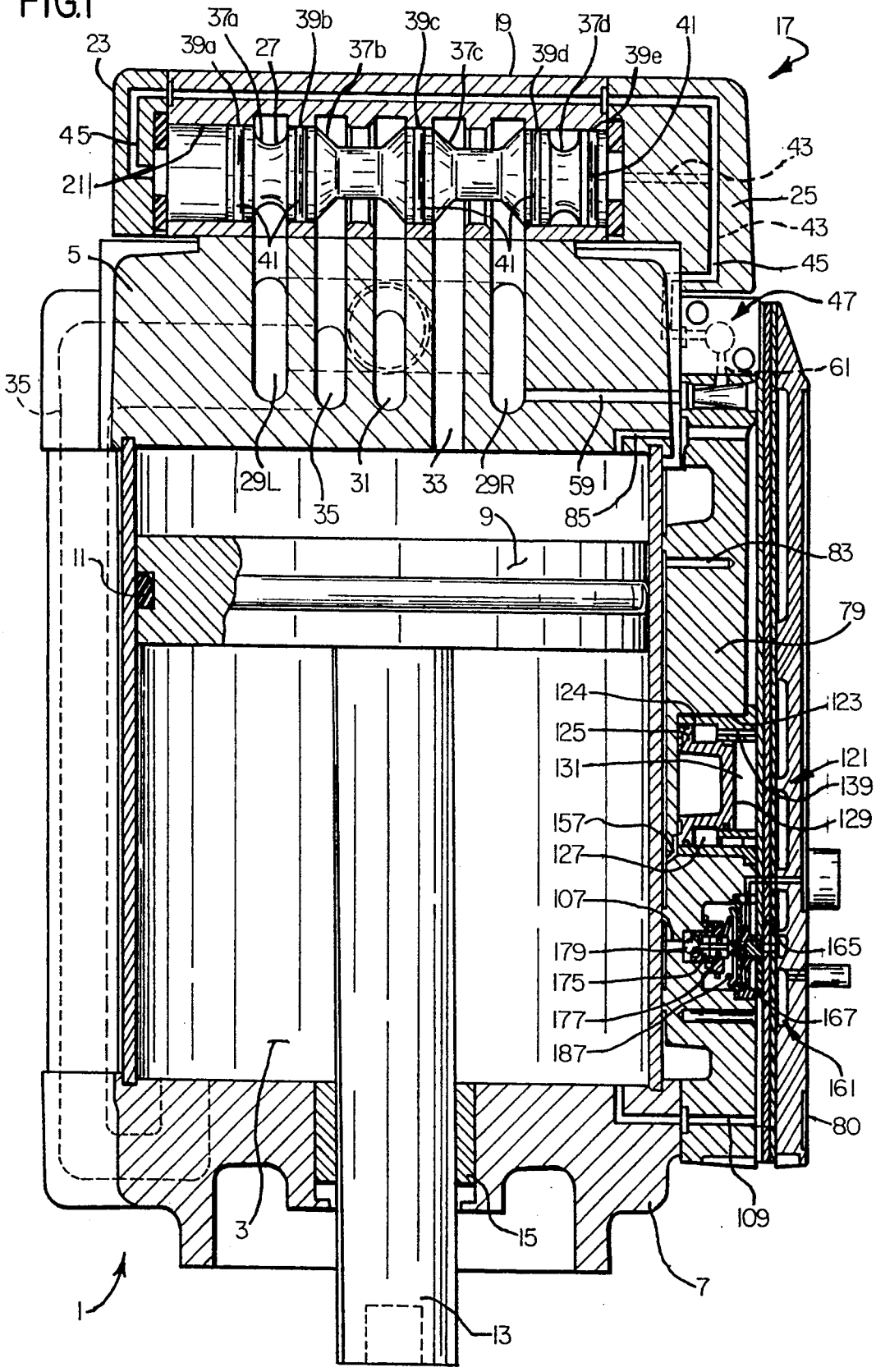
FIG. 1 is a vertical section of an air motor with a runaway control of the present invention, a piston of the air motor being shown generally at the upper end of its stroke.
Figure 2:
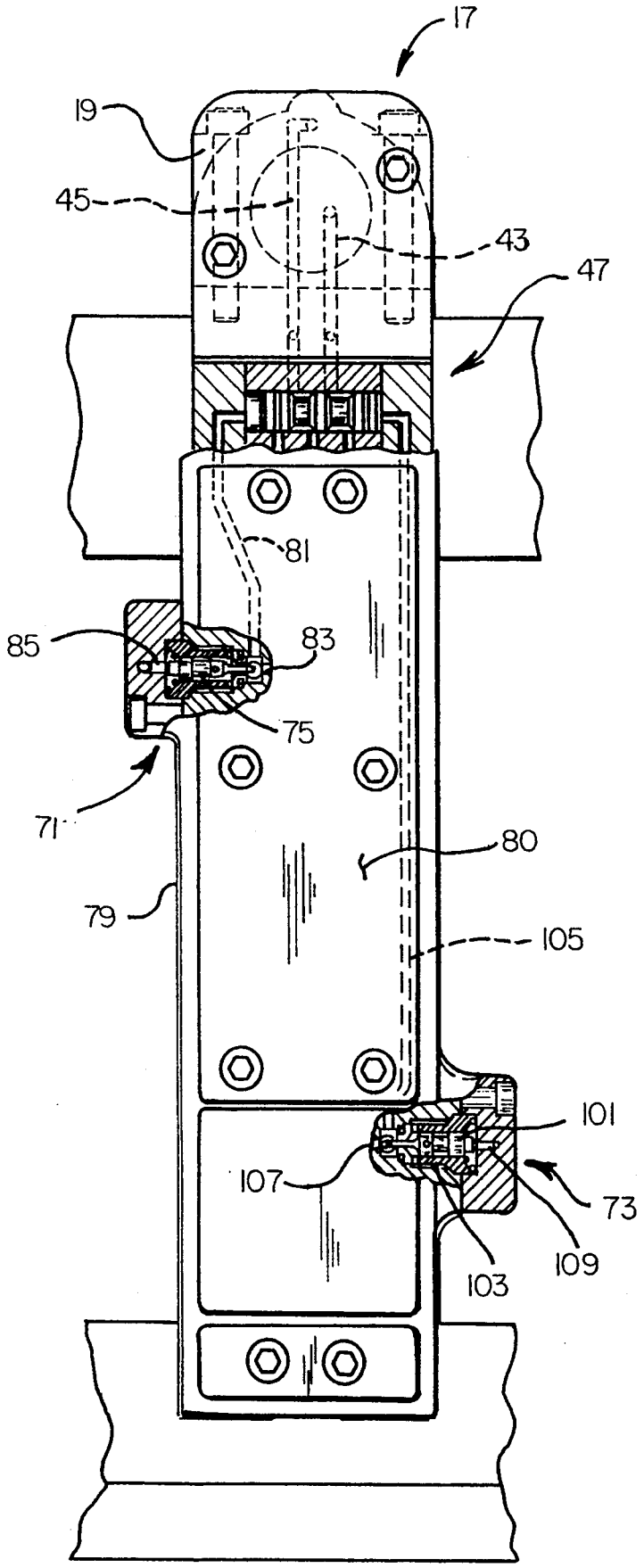
FIG. 2 is a side elevation with portions broken away of the air motor shown in FIG. 1.
Figure 3:
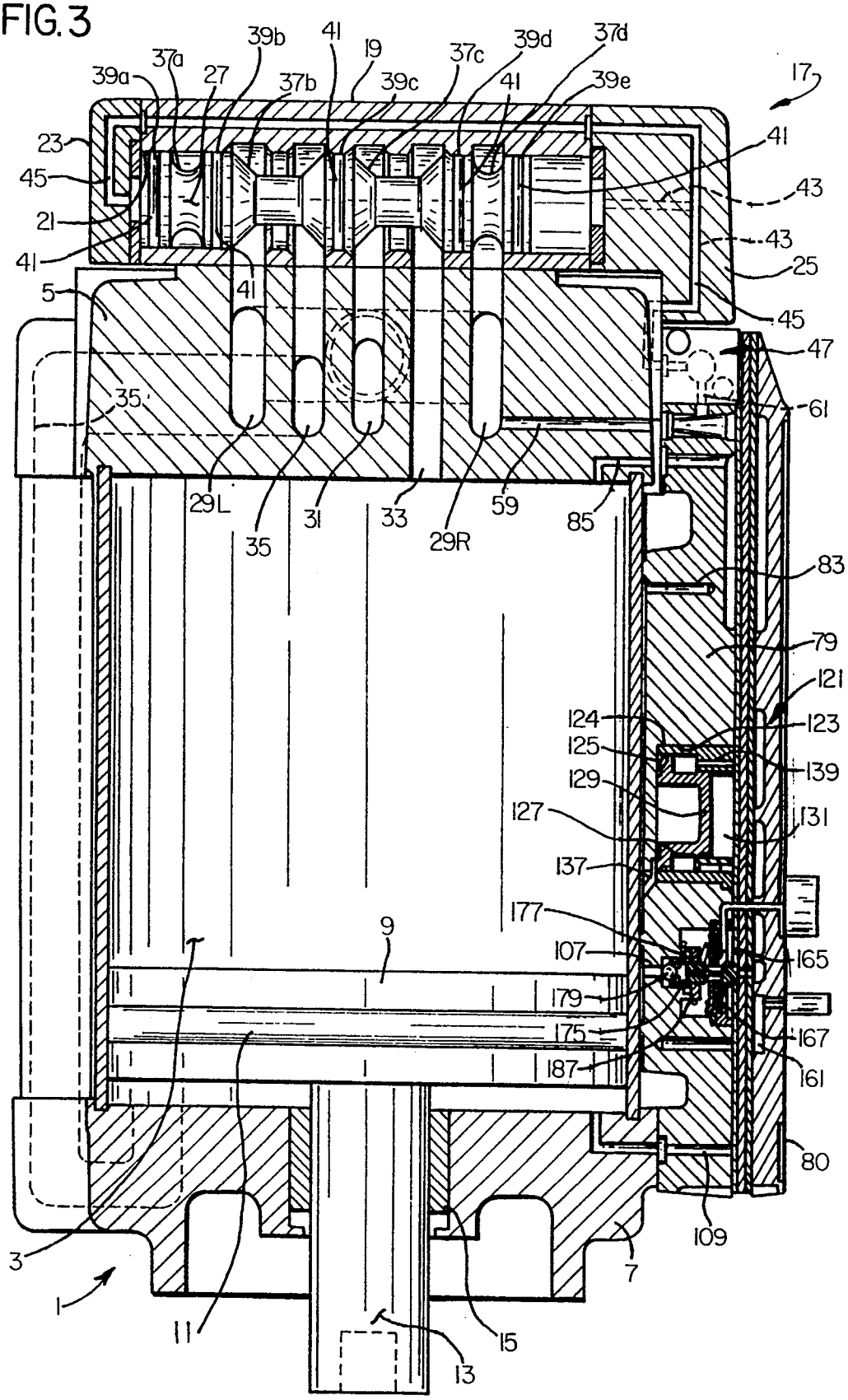
FIG. 3 is a view similar to FIG. 1, the piston being shown generally at the lower end of its stroke.

Referring to the drawings, there is generally indicated at 1 an air motor of the expansible chamber type to which the runaway control of this invention is applied. As shown, this motor is similar to that shown in the coassigned U.S. Pat. No. 4,846,045 of Ayzik Grach and Thomas M. Arens is issued Jul. 11, 1989. It comprises a cylinder 3 which as generally used occupies a vertical position as shown in FIGS. 1 and 3 and which has first and second end heads 5 and 7 at first and second ends thereof, the first being the upper and the second being the lower end head. The heads are secured on the upper and lower ends of the cylinder by bolts or hie rods (not shown) as in said U.S. Pat. 4,846,045. A motor piston 9 is reciprocable up and down in the cylinder, having an O-ring seal as indicated at 11. A piston rod 13 extends down from the piston through the lower end head 7, an O-ring seal for the rod being indicated at 15. The piston rod is adapted for connection in conventional manner at its lower end to the plunger of a pump (not shown) for pumping materials such as sealants.

Valve means generally designated 17 for controlling supply of pressure air from a source thereof to and exhaust of air from opposite ends of the cylinder 3 is mounted on the upper end head 5. This valve means, which may be referred to as the air directional valve means, comprises an elongate metal block 19 (e.g. a cast aluminum block) suitably secured on top of the upper end head having a cylindric bore 21 extending from one end thereof to the other and end heads 23 and 25 closing the ends of the bore. A valve member 27, more particularly a valve spool, is axially slidable in the bore between a first position toward the right end of the bore as shown in FIG. 1, for effecting delivery of pressure air from a source to the upper end of the cylinder and exhaust of air from the lower end of the cylinder for driving the piston down, and a second position toward the left end of the bore as shown in FIG. 3 for effecting delivery of pressure air from the source to the lower end of the cylinder and exhaust of air from the upper end of the cylinder for driving the piston upwardly. Pressure air is supplied from a suitable source to pressure supply ports 29L and 29R in the upper end head 5 which are in communication with the bore 21 in the valve block 19. At 31 is indicated an exhaust port in communication with the bore and with the ambient atmosphere. Delivery to and exhaust of air from the upper end of the cylinder (i.e., the chamber in the cylinder above the piston) is via passaging in the upper end head indicated at 33. Delivery to and exhaust of air from the lower end of the cylinder (i.e., the chamber in the cylinder below the piston) is via passaging indicated at 35. The valve spool is constructed as illustrated with annular grooves such as indicated at 37*a*, 37*b*, 37*c* and 37*d* between lands 39*a*, 39*b*, 39*c*, 39*d* and 39*e* to establish communication between ports 29R and 33 and between ports 35 and 31 when in its right-hand position of FIG. 1 and to establish communication between ports 29L and 35 and between ports 33 and 31 when in its left-hand position. The lands have seals such as indicated at 41.

Figure 4:
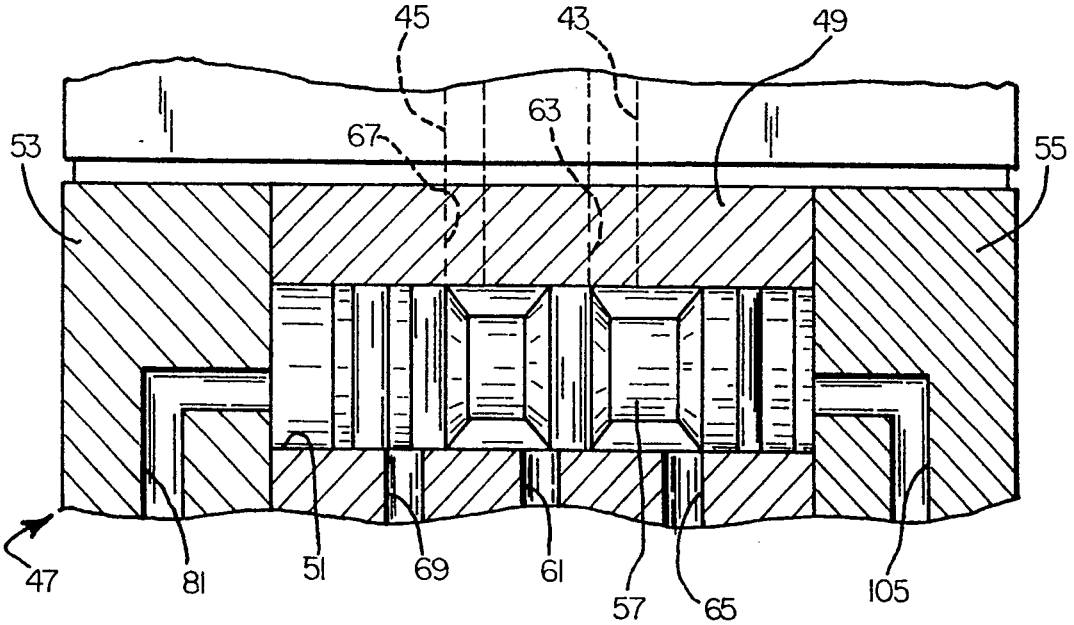
FIG. 4 is an enlarged section of a relay valve shown in FIG. 2.

The valve spool 27 is movable from its right-hand position of FIG. 1 to its left-hand position of FIG. 3 on delivery of pressure air to the right end of the bore 21 through passaging indicated at 43 in the upper end head 5 and in the valve block end head 25, and exhaust of air from the left end of the bore 21 via passaging indicated at 45 in the left end head 23 of the valve block 19 and in the block 19 and the right end head 25 of the block, and movable from its left-hand position to its right-hand position on delivery of pressure air to the left end of the bore 21 via passaging 45 and exhaust of air from the right end of the bore via passaging 43. The supply of air to and exhaust of air from the opposite ends of the bore 21 are under control of an air-operated relay valve 47 (see particularly FIG. 4) comprising a valve block 49 having a bore 51, left and right-hand end heads 53 and 55 for the bore 51 and a valve spool 57 slidable in the bore between a first position toward the right end of the bore and a second position toward the left end of the bore in its first position, the valve spool establishes communication for pressure air from pressure supply port 29R in the upper end head 5 of the cylinder 3 via a passage 59 in the upper end head 5 to a port 61 in the relay valve block 49 and thence via passaging 45, and for exhaust of air from the right end of the bore 21 via passaging 43, a transfer port 63 of the relay valve, and an exhaust port 65 of the relay valve. In its second position, the valve spool 57 establishes communication for pressure air from passage 59 and port 61 to port 63 of its relay valve and thence to passaging 43 and the right end of bore 21, and exhausts air from the left end of bore 21 via passaging 45, a port 67 of the relay valve and a relay valve exhaust port 69.

Figure 5:
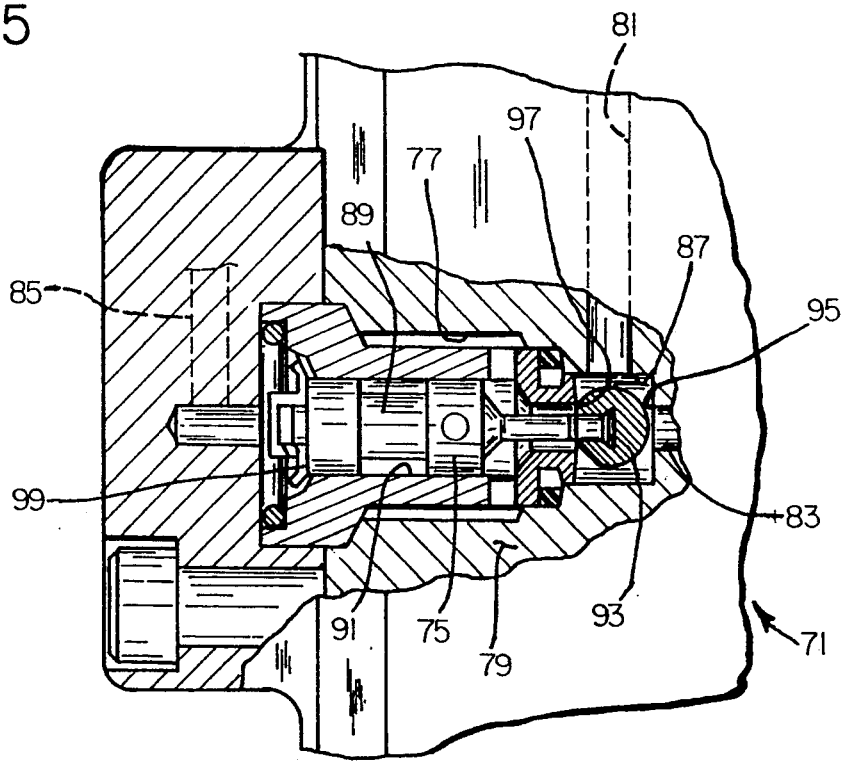
FIG. 5 is an enlarged section of a pilot valve shown in FIG. 2.

For operation of the relay valve 47, means indicated generally at 71 is provided for delivery of air under pressure to and exhaust of air from the left end of the relay valve bore 51 and means indicated generally at 73 is provided for delivery of air under pressure to and exhaust of air from the right end of the relay valve bore for shifting the relay valve spool between its stated first and second positions. The means 71 comprises a first pilot valve 75 (see FIG. 5) housed in a recess 77 at the upper end of a block 79 mounted at one side of the cylinder. A cover member 80 encloses the outer surface of the block 79 such that the required passaging between means 71, 73 and the relay valve 47 is located between the block and the cover member. This pilot valve is a pressure responsive valve in communication by passaging as indicated at 81 to the left end of bore 51 of relay valve 47 for delivery of air to and exhaust of air from the left end of the bore. The pilot valve is also in communication by passaging as indicated at 83 with the upper end of the cylinder 3. When the piston 9 is in its substantially up-stroke position, increased air pressure below the piston enters the passaging 83. The left end of the first pilot valve 75 is in communication with the top of the cylinder 3 by passaging 85, and upon increase of air pressure above the piston 9, pressurized air enters passaging 85. A chamber 87 is positioned between passaging 81 and 83 to allow communication therebetween. The first pilot valve 75 includes a valve system 89 slidable in a bore 91. The valve stem 89 has a ball valve member 93 attached to the right end of the valve stem within chamber 87, the ball valve member being engagable with a first valve seat 95 and a second valve seat 97 as the valve stem slides within the bore 91. A diaphragm member 99 is attached to the valve stem 89 at the left end of the valve. Valve 75 is freely movable from a position in which ball valve member 93 engages valve seat 95 for blocking communication between passaging 83 and passaging 81 to a position in which the ball valve member moves away from valve seat 95 in response to an increase in pressure in passaging 83 upon which the ball valve engages the second valve seat 97 and allows flow of air to and exhaust of air from the left end of the relay valve bore 51 via passaging 81 and passaging 83. Valve 75 is movable back to the position in which the ball valve member 93 blocks passaging 83 in response to an increase in pressure on the diaphragm member 99 from the top of the cylinder 3 via passaging 85. Thus, when piston 9 is in its substantially up-stroke position, increased air pressure below the piston enters passaging 83 and moves the ball valve member 93 away from the first valve seat 95 to engage the second valve seat 97 for passage of air to passaging 81 to move the relay valve spool 57 from its second position to its first position, which in turn moves valve spool 27 of the valve means 17 to its right-hand position for moving piston 9 downwardly. Upon increase of pressure above the piston, pressurized air enters passaging 85 which is received by the diaphragm member 99 for moving the ball valve member 93 back against the first valve seat 95, thus blocking passaging 81 so that the relay spool 57 may eventually move back to its second position upon delivery of pressurized air from means 73.

Means 73 comprises a second pilot valve 101 of the same construction as the first pilot valve 75, its parts being designated by the same reference numerals as the parts of the first. The second pilot valve 101 is mounted in opposed relation with respect to the first pilot valve in a recess 103 at the lower end of block 79. This pilot valve is also a pressure responsive valve in communication by passaging as indicated at 105 to the right end of bore 51 of relay valve 47 for delivery of air to and exhaust of air from the right end of the bore. The second pilot valve 101 is also in communication by passaging as indicated at 107 with the lower end of the cylinder 3. When the piston is in its substantially down-stroke position, increased air pressure above the piston enters the passaging 107. The right end of the second pilot valve 101 is in communication with the bottom of the cylinder 3 by passaging 109, and upon increase of air pressure below the piston, pressurized air enters passaging 109. As with the first pilot valve 75, the second pilot valve 101 also includes a valve seem 89 slidable within a bore 91. The valve stem 89 has a ball valve member 93 attached to the right end of the valve stem within chamber 87, the ball valve member being engagable with a first valve seat 95 and a second valve seat 97. A diaphragm member 99 is attached to the valve stem 89 at the left end of the valve. The arrangement is similar to the arrangement of first pilot valve 75 so that when piston 9 is in its substantially downstroke position, increased air pressure above the piston enters passaging 107 and moves the ball valve member 93 away from the first valve seat 95 to engage the second valve seat 97 in which air passes to passaging 105 to move the relay valve spool 57 from its first position to its second position which in turn moves valve spool 27 of the valve means 17 to its left-hand position for moving piston 9 upwardly. Upon increase of pressure below the piston, pressurized air enters passaging 109 which is received by the diaphragm member 99 for moving the ball valve member 93 against valve seat 95, thus, blocking passaging 105 so that the relay spool 57 may eventually move back to the first position upon delivery of pressurized air for means 71.

Figure 6:
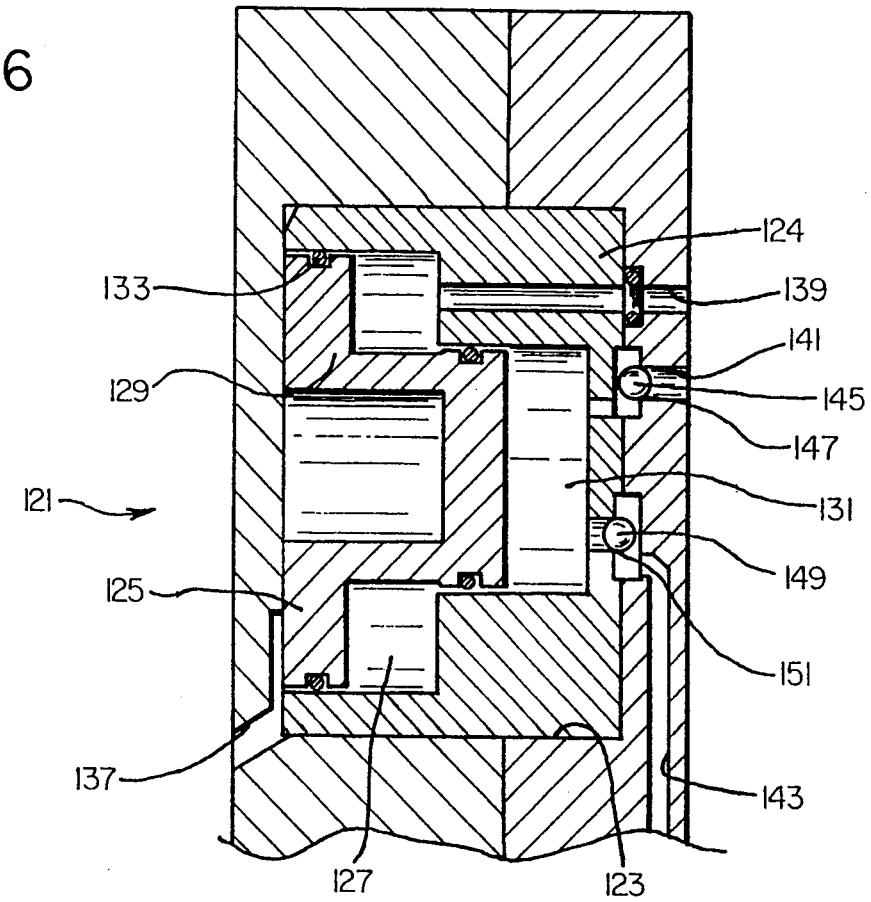
FIG. 6 is an enlarged section of an air pump shown in FIG. 1.

Referring now to FIG. 6, there is shown an air pump generally designated 121 which operates as a slave to the air motor and is housed in a recess 123 in the side of the block 79 generally between pilot valve 75 and pilot valve 101. Air pump 121 comprises a cylinder 124 having a first chamber constituting a motor chamber 127 and a second chamber constituting a pump chamber 131, and a piston 125 reciprocally movable in the motor chamber 127, and a plunger 129 movable conjointly with the piston in the pump chamber 131. As shown, the plunger 129 has a smaller diameter than piston 125 and extends from and is integral with the piston. O-rings 133, 135 maintain an air-tight seal between the piston 125 and the motor chamber 127, and the plunger 129 and the pump chamber 131, respectively, so that pressurized air in the chambers 127, 131 does not escape. The motor chamber 127 is in communication with the bottom of the cylinder 3 via passaging 137 located at the left end of the motor chamber, and in communication with top of the cylinder via passaging 139 located at the right end of the motor chamber. Upon increase of pressure in the bottom of cylinder 3, pressurized air is delivered to the air pump 121 through passaging 137 thereby forcing the piston 125 to the right to a first position, and upon an increase of pressure in the top of the cylinder 3, pressurized air is delivered to the air pump 121 through passaging 139 thereby forcing the piston 125 back to the left to a second position. When the piston 125 moves to its second position, the plunger 129 draws in atmospheric air into the pump chamber 131 through a vent 141. And, upon moving to its first position, the plunger 129 forces the air in the pump chamber 115 through a passageway 143. A ball check 145 engagable with a seat 147 is provided in vent 141 for preventing air in the pump chamber 131 from flowing back through the vent when the plunger 129 moves from its first position to its second position, and likewise, an identical ball check 149 engagable with a seat 151 is provided in passageway 143 for preventing the plunger 129 from drawing air into the pump chamber 131 when the plunger moves from its second position to its first position.

Figure 7:
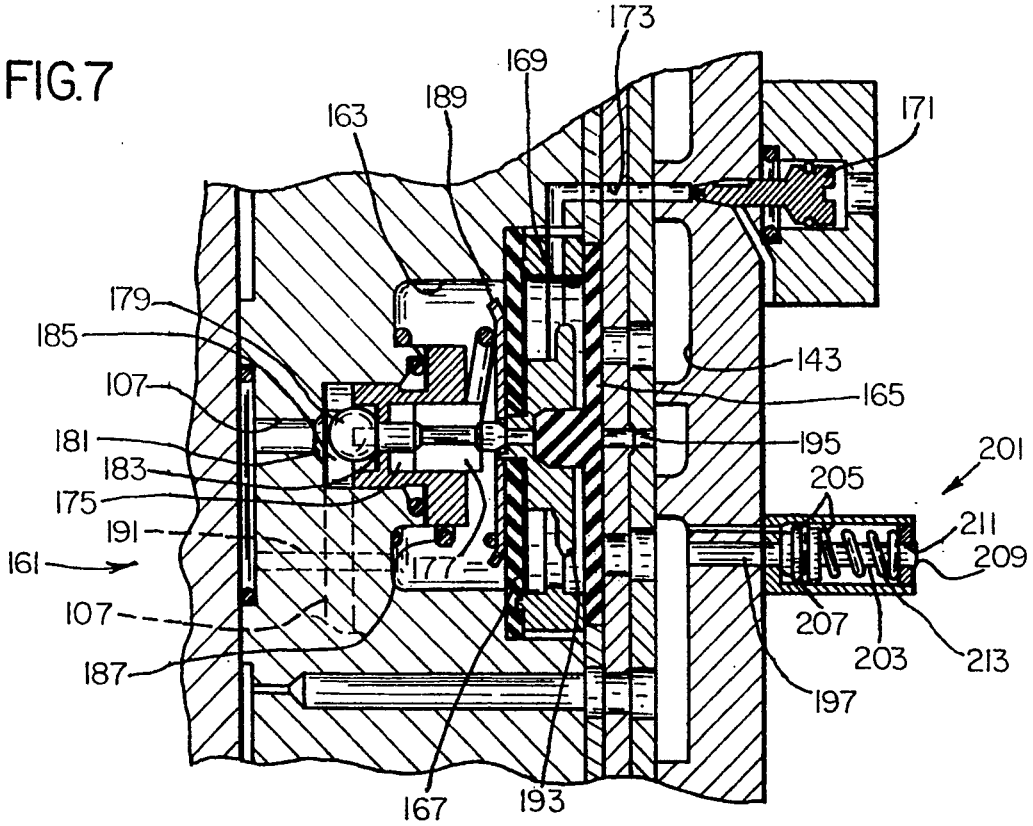
FIG. 7 is an enlarged section of pressure-responsive means shown in FIG. 1.
Figure 8:
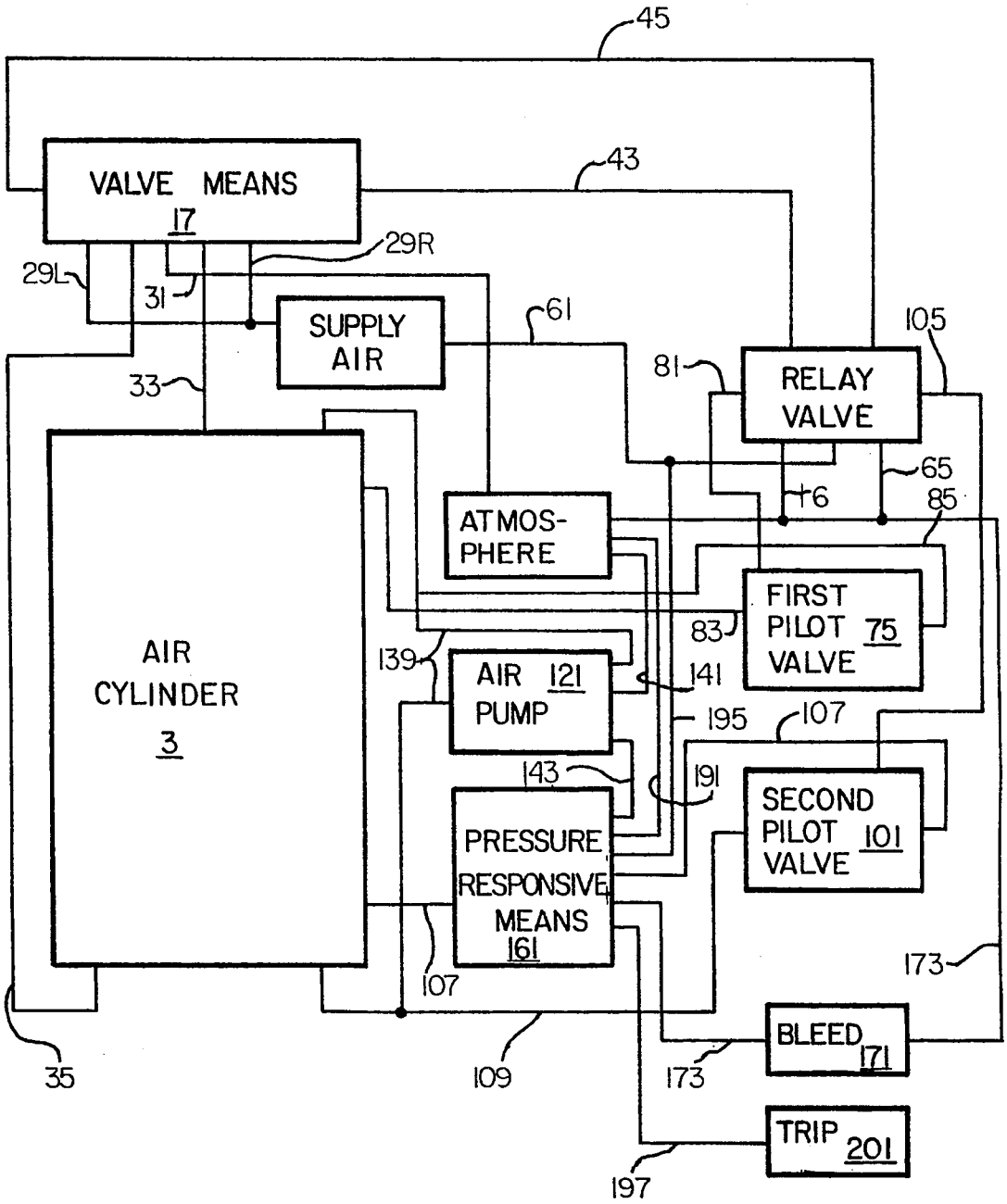
FIG. 8 is a diagram showing the air passaging system of the air motor and the control.

Passaging, including the passaging located between the block 79 and the cover member (e.g., passages 81, 107 and 143) and the passaging between the relay valve 47, valve meals 17 and cylinder 3, are illustrated schematically in FIG. 8. Passageway 143 connects the air pump 121 to pressure-responsive means, indicated generally at 161, which is located in a recess 163 in block 79 adjacent the air pump. The pressure-responsive means 161 comprises a first diaphragm 165 located at the right side of the recess and a second diaphragm 167 proximate the first diaphragm 165 and to the left thereof. As shown in FIG. 7, the space between diaphragms 165 and 167 defines a chamber 169 which receives pressurized air from the air pump 121 via passageway 143. Upon delivery of pressurized air from the air pump 121 to the chamber 169, the air is vented from the chamber by a bleed valve 171 in communication with the chamber via a passageway 173 at a rate consistent with the predetermined operating speed of the air motor. Bleed 171 is adjustable for varying the rate of bleed from chamber 169, i.e., the bleed may be adjusted to vent a maximum quantity of air when operating the air motor at an increased rate, or adjusted to vent a minimal quantity of air when operating the motor at a nominal rate. The bleed is also calibrated so that the air motor may operate below a predetermined speed, e.g., 50 or 75 cycles per minute. This allows the operator to accurately select the maximum predetermined rate of speed, rather than settling for a range of speeds.

Pressure-responsive means 161 further comprises a pressure-responsive valve 175 ("movable means") movable within the recess 163 upon an increase in pressure in chamber 169. Valve 175 includes a valve stem 177 which is connected at its right-hand end to the second diaphragm 167 and at its left-hand end to a ball valve member 179, the ball valve member being engagable with a first valve seat 181 located to the left of the ball valve member and a second valve seat 183 located to the right of the ball valve member. The space between valve seats 181, 183 defines a passage chamber 185 which is in communication with passaging 107 such that air traveling through the passaging must enter into and exit from the chamber 185 as the air travels to relay valve 47. The pressure-responsive valve 175 is movable from a first position in which the ball valve member 179 engages the second valve seat 183 (and spaced from the first valve seat 181) such that air flows through passaging 107 to maintain communication between cylinder 3 and pilot valve 101, and in response to increase in air pressure in the chamber 169 above a predetermined limit to a second position in which the ball valve member 179 engages the first valve seat 181 for blocking passaging 107, and therefore blocking flow of air to pilot valve 101. On blocking of passaging 107, the pilot valve 101 is unable to operate, thereby disabling the operation of the relay valve 47 which in turn disables the valve spool 27 for stopping the movement of piston 9 and cutting off the operation of the motor 1. The pressure-responsive valve 175 is movable back to its first position on reduction of pressure in the chamber 169 below the limit.

A spring 187, engageable with a washer 189 positioned adjacent the second diaphragm 167, biases the second diaphragm to maintain the pressure-responsive valve 175 in its stated first position. Upon increase of speed of the motor above a predetermined operating speed (e.g., 50 cycles per minute as set by bleed 171), the air pump 121, operating at increased speed, delivers air under pressure at an increased rate to the chamber 169 over and above the capability of the bleed 171 to bleed off the increase and over and above the resistance of the spring 187 on the second diaphragm 167. On the ensuing increase in air pressure in the chamber above the limit, the second diaphragm moves to the left against the bias of the spring so that the pressure-responsive valve 175 moves to its second position thereby blocking passaging 107 and cutting off the motor. A vent 191 exhausts built-up air pressure to the left of the second diaphragm to the atmosphere.

The previously described arrangement is such that the length of time from when the air motor reciprocates at the predetermined speed limit to when the air motor is cut off depends upon how much over the speed limit the air motor is reciprocating. The greater the speed of the motor, the shorter the length of time for increasing air pressure within chamber 169 over and above the resistance of spring 187 for moving pressure-responsive valve 175 to its second position. And conversely, a speed only marginally above the speed limit delivers pressurized air to chamber 169 at a slower rate, thereby increasing the amount of time needed to move the valve 175 to its second position.

The first and second diaphragms 165, 167 are interconnected at their respective centers by a member 193. The first diaphragm 165 is also biased by the spring 187 (via the force of the spring transmitted through diaphragm 167 and member 193) against the right-hand wall of the recess 163 to block a passageway 195 which is connected to an auxiliary air supply for supplying pressurized air on diaphragm 165 (which constitutes an auxiliary valve member). The auxiliary air supply assists in moving the pressure-responsive valve 175 to its second position. On the initial movement of the pressure-responsive valve 175 to its second position (as a result of increased pressure in chamber 169), the first diaphragm 165 moves away from the passageway 195 to an open position and auxiliary air pressure exerts pressure on the first diaphragm for facilitating the movement of the pressure-responsive valve to its second position. Only by closing the air supply and venting the air trapped in the recess 163 to the right of the first diaphragm may the pressure-responsive valve move back to its first position.

A trip indicator, indicated generally at 201, located on the exterior of the block 79 is in communication with the recess 163 to the right of the first diaphragm 165 by another passageway 197 and is activated upon increased pressure to the right of the first diaphragm as a result of pressurized air being supplied by the auxiliary air supply. As shown in FIG. 7, the trip indicator 201 includes a valve stein 203 slidable within a bore 205. Upon increased air pressure on the left-hand portion 207 of valve stem, it moves towards the right so that a narrower right-hand portion 209 of the stein extends through an opening 211 formed in the block 79. A spring 213 maintains the trip indicator 201 towards the left in the bore and only upon delivery of supply air on the left hand portion 207 of the stem 203 is the stem able to move against the bias of the spring. The right-hand and portion 209 of the stem 203 is colored red so that it may be visible to the operator. Upon activating the trip indicator 201, the operator knows that the air motor runaway control has been activated and that the air motor needs to be reset by shutting off the auxiliary air.

During operation of the air motor, piston 9 is movable up and down in cylinder 3 in response to pressurized air delivered by valve means 17. Piston 9 drives the plunger of the pump (not shown) connected at the lower end of the piston rod 13 for pumping materials such as sealants. In the event of the discharge line of the pump breaking, or exhaustion of the supply of the material being pumped, the piston 9 will tend to reciprocate in the cylinder 3 at high speed which can cause significant damage to the pump. In response to the increased speed of the piston 9, the air pump 121 of the runaway control operates at an increased speed since the air pump operates as a slave to the air motor. The air pump 121 in turn delivers pressurized air at an increased rate to chamber 169 of the pressure-responsive means 161. The pressure in the chamber 169 is controlled by bleed 171 via which the air entering the chamber from air pump 121 is vented from the chamber at a rate consistent with the predetermined operating speed of the air motor. In response to increase of air pressure in the chamber 169 over and above the capability of the bleed 171 to bleed off the increase, the pressure-responsive valve 175 moves to its second position in which its ball valve member 179 engages the first valve seat 181 for blocking passaging 107. The first diaphragm 165 also moves to a position away from passageway 195 thereby allowing auxiliary air pressure the be delivered on the first diaphragm for maintaining the blockage of passaging 107.

By blocking passaging 107, the second pilot valve 101 is incapable of allowing the delivery of pressurized air to passaging 105 for moving the relay valve spool 57 from its first position (i.e., right-hand position) to its second position (i.e., left-hand position) because pressurized air from the lower end of the cylinder entering passaging 107 above the piston when the piston is in its substantially down-stroke position is blocked from entering the second pilot valve 101. Since the relay valve spool 57 of the relay valve 47 is incapable of moving to its second position, the valve spool 27 of the valve means 17 is incapable of moving to its left-hand position. By maintaining the relay valve spool 57 in its first position, pressurized air from supply port 29R continues to be supplied to passaging 45 which keeps valve spool 27 in its right-hand position. With the valve spool 27 maintained in its right-hand position, pressurized air from supply port 29R continues to be supplied to the top of the cylinder 3 via passaging 33 above piston 9 thereby holding the piston in its down-stroke position.

By shutting off the auxiliary air supply (which applies pressure on diaphragm 165) and opening the bleed 171 for venting the built-up air pressure in the chamber 169, the air motor is reset for operation. Upon releasing the built-up air pressure in the chamber 169, the pressure-responsive valve 175 moves back to its first position under the bias of spring 187. Before the air motor is restarted, however, the cause for the air motor runaway must be attended to, e.g., the broken discharge line should be replaced, or the material being pumped should be resupplied.

In view of time above, it will be seen that the several objects of the invention are achieved and other advantageous results attained.

As various changes could be made in the above constructions without departing from the scope of the invention, it is intended that all matter contained in the above description as shown in the accompanying drawing shall be interpreted as illustrative and not in a limiting sense.

What is claimed is:

1. A runaway control for an air motor of the expansible chamber type comprising an air cylinder, a piston reciprocable therein, valve means shiftable alternately to effect supply of air to and venting of air from opposite sides of the piston to reciprocate the piston, said control being operable on increase in speed of the air motor above a speed limit to stop the motor and comprising pressure-responsive means comprising means defining an air chamber for air under pressure, means movable away from a first position in response to increase in air pressure in said chamber above a predetermined limit to a second position, and movable back to said first position on reduction of pressure in said chamber below said limit, said movable means widen in its first position enabling operation of the air motor and when in its second position cutting off the operation of the motor, said pressure-responsive means having a bleed for bleeding off pressure from the chamber at a controlled rate, an air pump controlled by the air motor, said pump being interconnected with the motor for operation simultaneously with the motor for delivering air under pressure at a rate related to the speed of the motor and having an outlet in communication with the chamber for the delivery of the air under pressure to the chamber, the pressure in the chamber being controlled by the rate of delivery of air under pressure to the chamber and the bleed of air from the chamber, whereby on increase in speed of the motor above said speed limit, the pump, operating at increased speed, delivers air under pressure at an increased rate to said chamber over and above the capability of the bleed to bleed off the increase, and on ensuing increase in air pressure in the chamber above said limit, said movable means moves to its said second position to cut off the motor.

2. A control as set forth in claim 1 wherein the bleed is adjustable for adjusting the rate of bleed.

3. A control as set forth in claim 2 wherein the bleed valve is calibrated for selectively choosing a specific speed limit.

4. A control as set forth in claim 1 having a passage for air for controlling operation of the motor and a valve controlled by said movable means for controlling the flow of air through said passage, said valve being open when the movable means is in its first position for flow of air through said passage for operation of the motor and being closed when the movable means is in its second position for cutting off flow of air through said passage for cutting off the operation of the motor.

5. A control as set forth in claim 4 wherein the passage includes a passage chamber, said valve on said movable means comprising a valve member engagable with a valve seat in the passage chamber and movable between said stated first and second positions, said valve member blocking the flow of air moving through the passage when in its second position.

6. A control as set forth in claim 5 wherein said valve on said movable means further comprises a diaphragm defining a wall in the air chamber, said diaphragm being movable with the valve member and being biased to maintain said valve member in its stated first position, whereby on increase of air pressure in the air chamber above the speed limit of the motor, the diaphragm, responding to the increased air pressure, moves said valve member to its second position in which it blocks the flow of air moving through the passage.

7. A control as set forth in claim 6 wherein said valve further comprises a second diaphragm, spaced from the first said diaphragm, said second diaphragm defining a second wall in the air chamber.

8. A control as set forth in claim 7 further having means for delivery of auxiliary air under pressure to said chamber in addition to the delivery of air by said air pump, said second diaphragm being associated with said movable means and movable with the latter between a closed position for closing off the delivery of auxiliary air and an open position for the delivery of auxiliary air to the chamber, said second diaphragm moving to its open position on the initial movement of the movable means toward its second position for cutting off operation of the motor.

9. A control as set forth in claim 1 further having means for delivery of auxiliary air under pressure to said chamber in addition to the delivery of air by said air pump, said means including an auxiliary valve member associated with said movable means movable with the latter between a closed position for closing off the delivery of auxiliary air and an open position for the delivery of auxiliary air to the chamber, said auxiliary valve member moving to its open position on the initial movement of the movable means toward its second position for supplying auxiliary air pressure on said movable means for cutting off operation of the motor.

10. A control as set forth in claim 1 wherein the pressure responsive means, and air pump are housed in a block which is mounted on a side of the cylinder.

11. A control as set forth in claim 1 wherein the length of time for cutting off the motor is dependent upon the speed of the motor above the speed limit, the greater the speed of the motor, the shorter the length of time for cutting off the motor.

* * * * *